United States Patent [19]

Allen

[11] 4,276,789

[45] Jul. 7, 1981

[54] CORK EXTRACTOR

[75] Inventor: Herbert Allen, Houston, Tex.

[73] Assignee: Hallen Company, Houston, Tex.

[21] Appl. No.: 925,365

[22] Filed: Jul. 17, 1978

[51] Int. Cl.[3] ..... B67B 7/00

[52] U.S. Cl. ..... 81/3.36; 81/3.48

[58] Field of Search ..... 30/346, 346.53, 350; 81/3.1 A, 3.36, 3.37, 3.38 R, 3.38 A, 3.48

[56] References Cited

U.S. PATENT DOCUMENTS

| | | | |
|---|---|---|---|
| 279,203 | 6/1883 | Strait | 81/3.38 A |
| 3,203,829 | 8/1965 | Seyer et al. | 30/346.53 X |

FOREIGN PATENT DOCUMENTS

| | | | |
|---|---|---|---|
| 1048501 | 1/1959 | Fed. Rep. of Germany | 81/3.38 A |
| 2340898 | 9/1977 | France | 81/3.48 |

*Primary Examiner*—James G. Smith

*Attorney, Agent, or Firm*—Browning, Bushman & Zamecki

[57] ABSTRACT

The invention pertains to an apparatus for extracting a cork from a bottle comprising a cork-engaging member, including a corkscrew, and a holder for aligning and guiding the corkscrew, via its own diameter, with respect to the bottle. The cork-engaging member is completely removable from the holder for independent use, and to permit the corkscrew point to be used to sever the metal foil, which covers the bottle top, and both the holder and cork engaging member to be more easily cleaned. The holder includes a plurality of longitudinally extending circumferentially spaced, radially deflectable gripping elements connected to and spaced downwardly from a guide which receives the corkscrew, and are all approximately equally resiliently biased to a normal unflexed radial position. One embodiment is capable of two alternative modes of operation. The corkscrew itself is improved by the provision of an outer layer of friction reducing material.

32 Claims, 12 Drawing Figures

FIG. 3
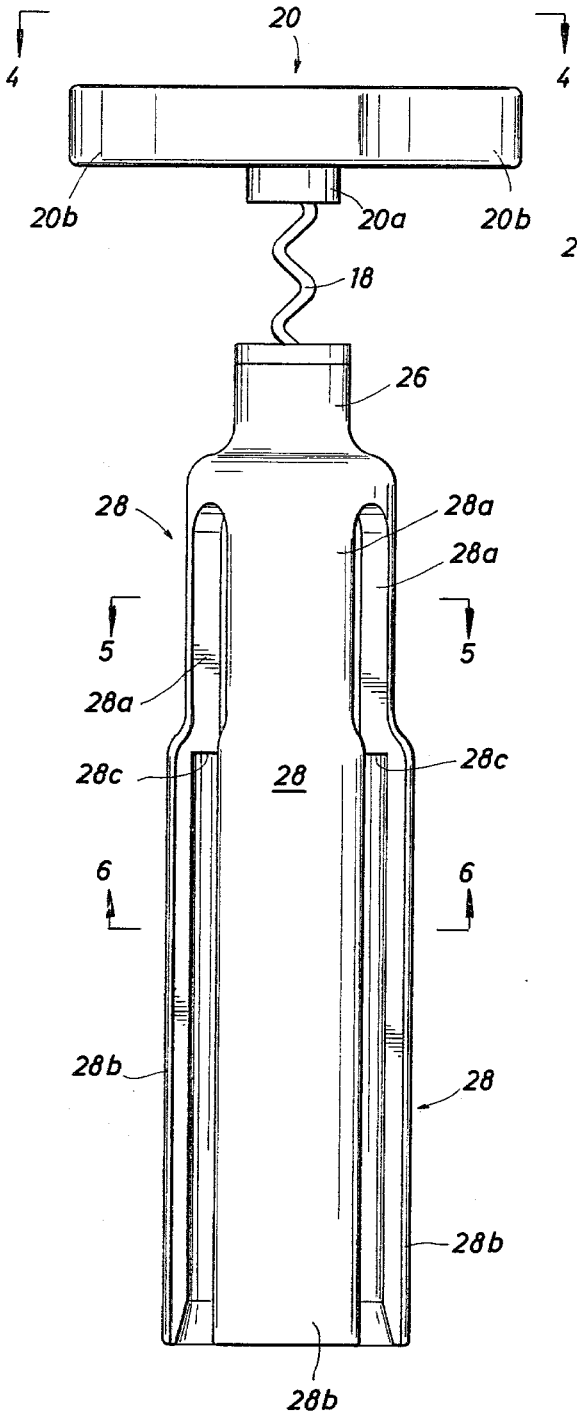
FIG. 4
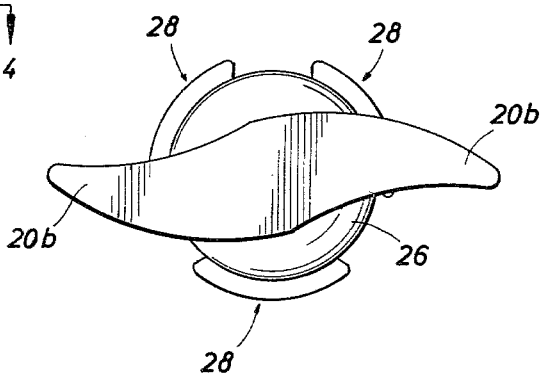
FIG. 5
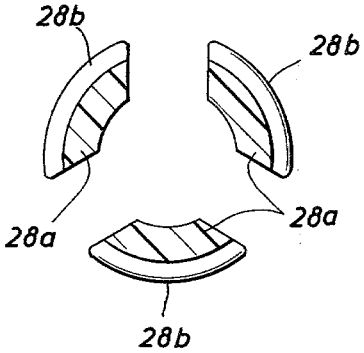
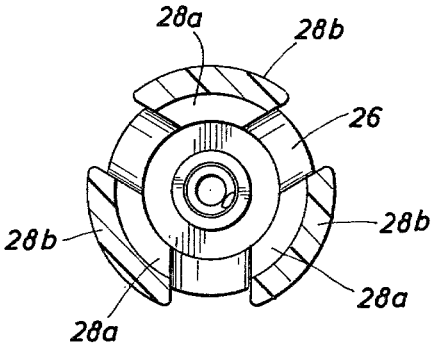
FIG. 6

FIG. 9
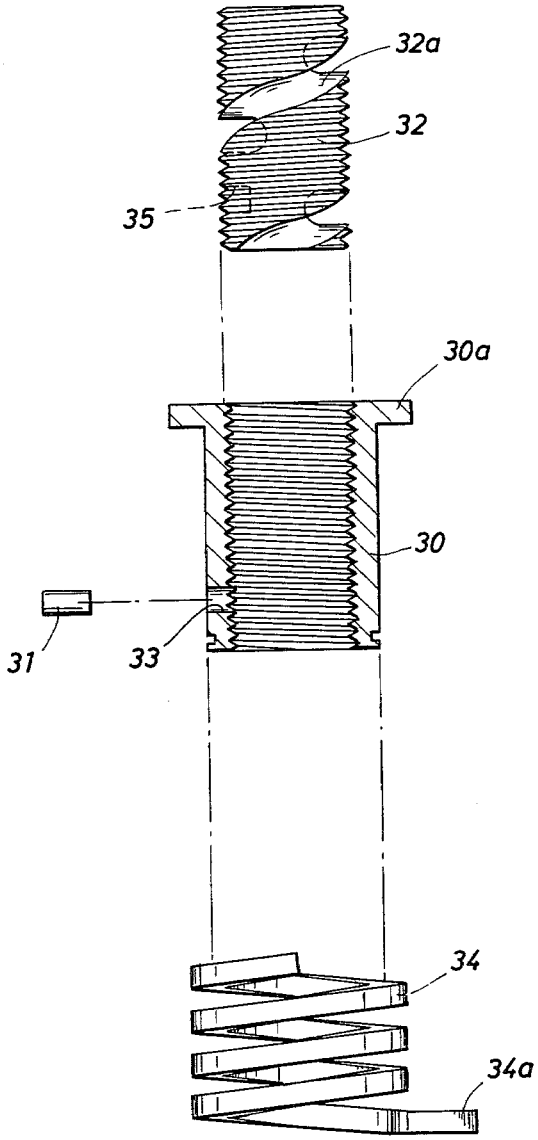
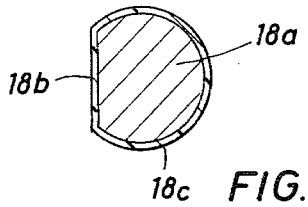
FIG. 11
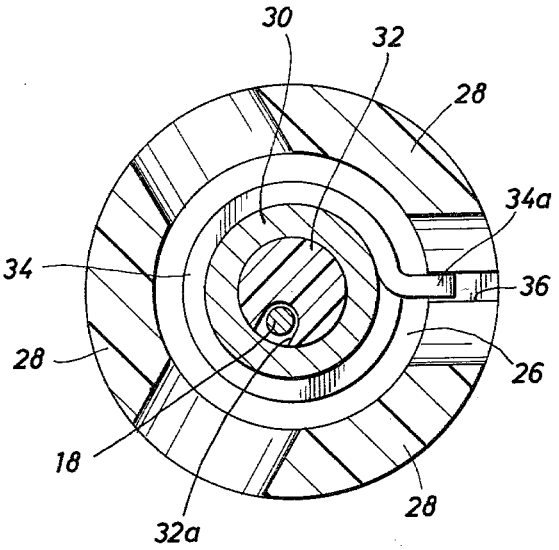
FIG. 10
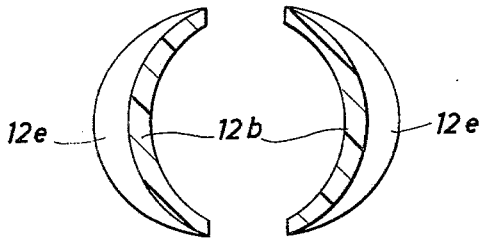
FIG. 12

CORK EXTRACTOR

BACKGROUND OF THE INVENTION

1. Field of the Invention

The present invention pertains to apparatus for extracting corks from bottles. A number of features are desirable in such an apparatus. One of the most important of these is that the corkscrew portion of the apparatus be well centered in the cork during operation, so as to ensure the removal of the entire cork, and minimizing the possibility of breaking the cork and permitting the resulting fragments to fall into the wine in the bottle. Another important consideration is that the corkscrew must be pulled in a substantially straight line along its own axis when the cork is being removed, and this axis should ordinarily be substantially aligned with that of the bottle, so as to facilitate removal. Another desirable feature in a cork extracting apparatus is the provision of means to reduce the manual force required to drive the corkscrew into the cork and/or to extract the cork from the bottle. There is also a need for such an apparatus in which it is not necessary to drive the corkscrew completely through the lower end of the cork before pulling it.

2. Description of the Prior Art

Although numerous types of cork extractors have been designed in the past, they have fallen short of adequately filling the various needs described above. More particularly, the prior art has failed to produce a simple, relatively inexpensive device which incorporates all of the aforementioned desirable features.

For example, British Pat. No. 192,503 to Joyce discloses one of the simplest types of such apparatus, merely comprising the corkscrew per se and an attached handle. The handle includes a bevelled surface for abutting the top of the bottle so that, once the screw has been driven into the cork a sufficient distance to achieve such abutment, continued rotation will cause the cork to rise on the corkscrew. This somewhat reduces the force which must be exerted to remove the cork from the bottle, and also provides some small degree of guidance during removal. However, there is no means for initially centering and aligning the corkscrew with the cork as it is driven thereinto.

Various other schemes have been devised for reducing the amount of manual force which must be exerted to remove a cork from a bottle. For example, British Pat. No. 2576 to Chinnock discloses an apparatus having a telescoping base and corkscrew portion with "snail" formations cooperative therebetween to permit the cork to be removed by a continuation of the rotary motion with which the corkscrew is driven into the cork. British Pat. Nos. 14,839 and 570,680 describe somewhat more elaborate mechansims in which rotation of a handle or the like causes the corkscrew and engaged cork to move upwardly, but without rotation, via a member mounted above the corkscrew and threaded to the rotating handle. Still other devices, exemplified by British Pat. No. 366,435, employ more or less complicated systems of levers in pulling the cork.

The above types of cork extractors suffer from several common disadvantages. They are unduly mechanically complicated, which increases their cost as well as their susceptibility to damage and failure; and they fail to provide adequate alignment and guidance of the corkscrew as it is being driven into the cork. Other prior inventors have addressed the alignment/centering/guidance problem, e.g. Campagnolo in British Pat. No. 1,188,579 and Becker in British Pat. No. 17,924. However, the devices resulting from such efforts did not adequately solve that problem and/or were as mechanically complicated, or even more so, as the other types of cork extractors discussed hereinabove. In short, the prior art devices require more stength, patience, and/or skill than is possessed by the average user.

SUMMARY OF THE INVENTION

The present invention provides a simple, inexpensive apparatus for extracting a cork from a bottle including a holder and a cork-engaging member. The cork-engaging member includes the corkscrew per se and abutment means, such as a handle, carried on the corkscrew and engageable with the holder to limit downward movement of the cork engaging member with respect to the holder in use. The holder includes guide means having a guide passageway extending generally longitudinally therethrough. The guide passageway has guide surface means facing generally radially inwardly and is sized to lie closely adjacent the outer diameter of the corkscrew helix, the corkscrew being rotatably and longitudinally movable in the guide passage. The holder further includes stop means engageable with the bottle to limit downward movement of the holder with respect to the bottle as well as grip means spaced downwardly from the guide means and engageable with the bottle to radially align the guide means with the bottle. Thus, the grip means in conjunction with the stop means of the holder serve to generally radially center and coaxially align the quide means, and thus the corkscrew received therein, with the bottle and its cork.

By rotating the cork engaging member and simultaneously exerting a downward force thereon, the corkscrew may be driven into the cork while still properly centered and aligned therewith by the holder. When the abutment means of the cork engaging member comes into abutment with the holder, thereby preventing further downward movement of the cork engaging member, continued rotation of that member in the same direction will cause the cork to rise on the helical corkscrew, the guide means being spaced above the top of the bottle by a sufficient distance to permit such movement.

The holder includes several features which enhance the alignment and centering function thereof. Specifically, the aforementioned grip means comprises a plurality of longitudinally extending circumferentially spaced, radially deflectable gripping elements approximately equally resiliently biased to a normal unflexed radial position. Such gripping elements provide a relatively inexpensive means for laterally gripping the bottle by its drip ring and/or neck. The approximately equal biasing of the various gripping elements prevents canting of the holder on the bottle thereby assuring that the guide means is properly aligned with the cork. Furthermore, the radial deflectability of the gripping elements enables them to accommodate bottles of various sizes.

The aforementioned stop means are preferably in the form of one or more downwardly facing shoulders defining a plane generally transverse to the holder and engageable with the top of the bottle. This contrasts with the various prior art devices in which a bevelled, frusto-conical, paraboloid, or otherwise tapered shoulder is provided, and thereby enhances the tendency of the holder to steadily align itself with the bottle, rather than permitting canting and wobbling as do the prior art devices. To further augment this tendency, the grip means may be provided with bearing surfaces spaced downwardly from the stop shoulders and engageable to urge the stop shoulders downwardly into tight engagement with the top of the bottle. For example, the aforementioned gripping elements may have their outer sides flared radially outwardly near the bottom ends thereof to provide such bearing surfaces.

In one embodiment of the invention, the guide passageway is helical, being defined by a bushing means mounted in a generally annular foundation portion of the guide means. Means are provided cooperative between this foundation portion and the bushing to permit relative rotation of the two in a first directional mode but prevent relative rotation in an opposite mode. This permits the apparatus to be used in either of two ways. The first is substantially identical to that described above; namely, the cork engaging member is rotated and urged downwardly to drive the corkscrew into the cork until the abutment means thereon comes into engagement with the holder. The aforementioned mounting of the bushing in the foundation portion of the guide means then permits continued rotation of the cork engaging member, along with the bushing, so that the cork will rise on the corkscrew.

Alternatively, the corkscrew may be driven into the cork, guided by the guide means, to a desired point, which need not involve passage of the screw entirely through the cork nor engagement of the abutment means with the holder. The holder itself is then rotated in the direction such that the bushing member will be constrained to rotate therewith. Thus, the corkscrew and engaged cork will be moved longitudinally upwardly due to the thread-like interengagement between the corkscrew and the bushing. However, the latter movement will be straight longitudinal movement unaccompanied by rotation.

Another salient feature of the invention is that the cork engaging member is completely separable from the holder. This permits the sharp lower tip of the corkscrew to be used to sever the foil which covers the cork and top of an unopened bottle of wine. The separability of the cork-engaging member also permits it to be used as a simple corkscrew without the holder if, for any reason, such use might be desired. Finally, the separability of the two main portions of the apparatus permits each of these portions to be more readily cleaned.

Finally, the corkscrew itself is improved by the provision of a central body, e.g. of high tensile metal, covered by an outer layer of friction reducing material such as polytetrafluoroethylene. This greatly enhances the ease with which the corkscrew may be driven into the cork. This friction reducing expedient not only virtually eliminates the aforementioned problem in many prior art corkscrews of the inability to penetrate a tight cork to a sufficient depth, but also permits the use of design features in the central body, which could not be used without the friction reducing layer, and which themselves enhance the ease of insertion and otherwise improve the corkscrew. Accordingly, the friction reducing layer on the corkscrew is largely instrumental in making the relatively simple apparatus described above effective in easily penetrating and properly removing even extremely hard and/or tight corks. Furthermore, to help prevent wear of the friction reducing layer, the corkscrew may be formed to include a radially outwardly facing flat formed along at least a substantial portion of its length, which increases the surface available for bearing against the guide means.

Accordingly, it is a principal object of the present invention to provide a simple, economical cork extractor including means for effectively centering and aligning the corkscrew with the cork as it is being driven thereinto.

Another object of the present invention is to provide an improved cork extractor having separable cork engaging and holder portions.

Still another object of the present invention is to provide a cork extractor having alternative methods of use.

Yet a further object of the present invention is to provide a cork extractor including grip means adaptable for engagement with various sizes of bottles.

Still another object of the present invention is to provide an improved corkscrew having an outer layer of friction reducing material.

Other objects, features and advantages of the present invention will be made apparent by the following detailed description of the preferred embodiments, along with the drawings and the claims.

BRIEF DESCRIPTION OF THE DRAWING

FIG. 3 is an elevational view of a second embodiment of the invention.

FIG. 4 is a top plan view of the embodiment of FIG. 3.

FIG. 5 is a transverse cross-sectional view taken along line 5—5 of FIG. 3.

FIG. 6 is a transverse cross-sectional view taken along line 6—6 of FIG. 3.

FIG. 9 is an exploded view on an enlarged scale of the bushing assembly of the apparatus of FIGS. 3-8.

FIG. 10 is a transverse cross-sectional view taken along line 10—10 of FIG. 7.

FIG. 11 is an enlarged detailed sectional view taken on line 11—11 of FIG. 2.

FIG. 12 is a transverse cross-sectional view taken on line 12—12 of FIG. 1.

DESCRIPTION OF THE PREFERRED EMBODIMENTS

Figure 1:
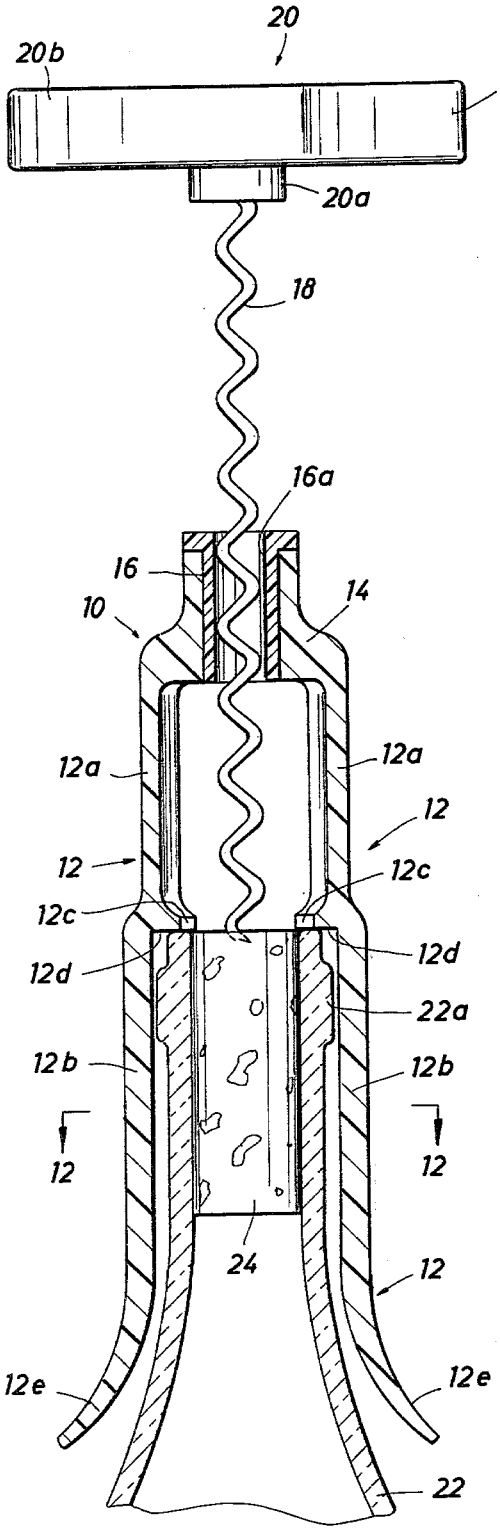
FIG. 1 is a longitudinal sectional view, with some parts being shown in elevation, of a first embodiment of the invention positioned on a bottle for extracting the cork therefrom.
Figure 2:
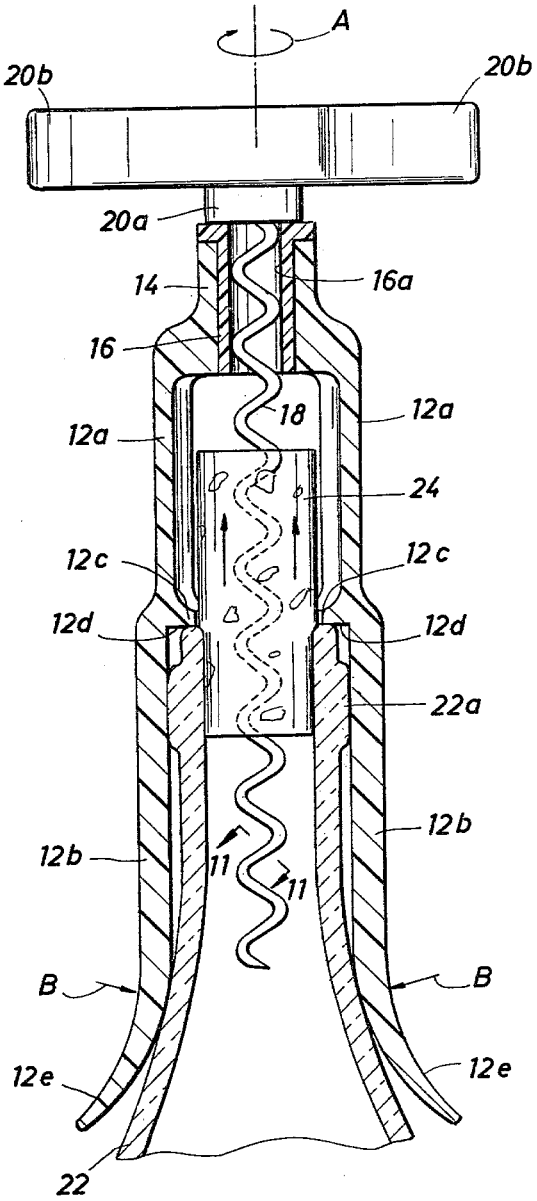
FIG. 2 is a view similar to that of FIG. 1 showing the apparatus in another position as the cork is being removed from the bottle.

FIGS. 1, 2, 11 and 12 illustrate a cork extracting apparatus according to a first embodiment of the invention. Referring first to FIGS. 1 and 2, the apparatus generally comprises two main portions, namely a holder and a cork engaging member. The holder includes a main body member 10 which, in the embodiment shown, is integrally molded from a suitable plastic. The main body member 10 includes a pair of diametrically opposed, circumferentially spaced apart, longitudinally extending flexible legs 12, each of which comprises an upper portion 12*a* and a lower portion 12*b*. The main body member 10 of the holder further includes an annulus 14 interconnecting and extending upwardly from the upper ends of legs 12. Annulus 14 serves as the foundation portion of the guide means of the holder, said guide means further including a bushing member 16 rigidly mounted within annulus 14 in any suitable manner. Bushing member 16 is preferably formed of a friction reducing material such as polytetrafluoroethylene and is in the form of a sleeve which extends longitudinally along the inner surface of annulus 14 and has an annular flange extending radially outwardly from the upper end and abutting the uppermost surface of annulus 14. It is noted that, as used herein, terms such as "upper," "lower," "upwardly" and "downwardly" refer to the apparatus as shown in the drawings and as it would be positioned for use on an upright bottle. Such terms are used for convenience, and should not be construed in a limiting sense.

The other major portion of the cork extracting apparatus is a cork engaging member including a helical corkscrew 18 and a handle 20. The corkscrew 18 serves as the guide portion of the cork engaging member and is thus removably receivable in bushing 16 of the guide means of the holder. Corkscrew 18 is longitudinally movable in the bore defined by surface 16*a* either with or without simultaneous rotation. The outer diameter of the helix of corkscrew 18 is sized to lie closely adjacent the cylindrical radially inwardly facing surface 16*a* of the bushing 16 of guide means. Additionally, the length of cylindrical surface 16*a* is at least as long as, and preferably longer than, the pitch of the helix of corkscrew 18. Accordingly, surface 16*a* serves as the guide surface means of the holder, defining a guide passageway for corkscrew 18 and maintaining it in substantial coaxial alignment with the guide means 14, 16.

The handle 20 includes a lowermost annular hub 20*a* and a pair of diametrically opposed radially extending arms 20*b*. Hub 20*a* is sized and positioned to abut the upper surface of bushing 16 as corkscrew 18 moves downwardly therein to thereby limit downward movement of the cork engaging member 18, 20 with respect to the holder 12, 14, 16.

To use the apparatus, the holder 12, 14, 16 is emplaced over the top of the bottle 22. Each of the legs 12 has a flange 12*c* extending radially inwardly adjacent the juncture of the upper and lower portions 12*a* and 12*b* respectively of the leg. The lower surfaces 12*d* of the flanges 12*c* lie in a common plane transverse to the longitudinal axis of the holder. Thus, the surfaces define stop shoulders which abut the top of the bottle 22 and thereby limit downward movement of the holder with respect thereto. Accordingly, when the holder has been thus placed on the bottle 22, as shown in FIG. 1, the holder legs 12 are positioned with the upper portions 12*a* thereof extending upwardly from the top of the bottle 22 whereby the guide means 14, 16 is spaced from the top of the bottle and a cork receiving space is formed between the upper portions 12*a* of the two holder legs and intermediate the guide means 14, 16 and the flanges 12*c*.

The lower portions 12*b* of holder legs 12 extend downwardly along the neck of bottle 22. These portions 12*b* serve as the gripping elements of the holder. Legs 12 are formed of a suitable lightweight material such as plastic, aluminum or the like and have sufficient inherent flexibility and resiliency to permit gripping elements 12*b* to be flexed either inwardly or outwardly from the normal unflexed radial position shown in FIG. 1. Thus, the gripping elements 12*b* may be grasped and squeezed inwardly by the user with one hand to grip the neck of bottle 22 and firmly position the holder thereon. The flexibility of holder legs 12 also permits the holder to accommodate bottles of different sizes.

Because holder legs 12 are formed of the same material, are substantially identical in size and configuration, and are symmetrically positioned with respect to annulus 14, they are substantially equally biased to the normal unflexed radial position shown in FIG. 1. Accordingly, when they are urged inwardly by the user, as indicated by the arrows B in FIG. 2, they tend to maintain the guide means 14, 16 in a position which is substantially centered with respect to the bottle 22 and its cork 24, even if the diameter of the drip ring 22*a* of the bottle neck differs from the distance between the adjacent portions of the gripping elements 12*b*. Furthermore, such equal resilient biasing further helps to prevent canting of the holder on the bottle and thereby maintain the axis of the guide means 14, 16 substantially coaxially aligned with that of the bottle 22.

This latter effect is further enhanced by the fact that the stop shoulders 12*d* define a plane transverse to the two aforementioned axes. In order to take full advantage of this expedient, the gripping elements, i.e. lower portions 12*b* of the holder legs 12, are flared radially outwardly at their lower ends whereby generally upwardly facing bearing surfaces 12*e* are formed on their outer sides. This assists the user in squeezing inwardly on gripping elements 12*b* while simultaneously bearing down on surfaces 12*e* to thereby hold both shoulders 12*d* in firm engagement with the top of the bottle.

When the gripping elements are thus employed, they will engage and grip the bottle neck at least at the drip ring 22*a*. It is primarily the flexibility of the upper portions 12*a* of the holder legs which permits radial flexing of gripping elements 12*b* to accommodate drip rings of differing sizes. However, gripping elements 12*b* are additionally flexible and resilient within themselves. Thus, depending upon the diameter of the bottle to be gripped and the length and degree of flexibility of gripping elements 12*b*, the lower ends of the gripping elements 12*b* may be flexed inwardly to further engage and grip the bottle neck at a second location spaced downwardly from drip ring 22*a*. It has been observed that the tapered necks of most wine bottles reach an outer diameter approximately equal to that of their drip rings at a location around 2 to 2.5 inches (about 5 to 6.5 cm.) below the top of the bottle. Accordingly, if the gripping elements 12*b* are sized so that there is a like distance between stop shoulders 12*d* and the points at which the gripping elements 12*b* begin to flare outwardly, this double gripping action may be more readily achieved with a minimum of distortion of the gripping elements. Nevertheless, even where such double gripping is not possible, due to the size of the bottle and/or the length of gripping elements 16*b*, proper alignment of the guide means 14, 16 with the cork 24 can still be maintained by the combined action of engaging the upper edge of bottle 22 with shoulders 12*d* and gripping drip ring 22*a* with gripping elements 12*b*.

In any event, it is desirable to make the gripping elements 12*b* at least long enough to enable the user to firmly grip the holder in an area primarily surrounding and aligned with the bottle neck, as opposed to an area located generally thereabove. It will also be observed that legs 12 are inwardly concave (as shown in FIG. 12) to enhance the gripping ability thereof.

Referring now to FIGS. 1 and 2 together, the operation of the cork extractor is as follows. After the holder has been emplaced on the bottle as shown in FIG. 1 and described hereinabove, the corkscrew 18 is inserted in the bushing 16 so that its lower end abuts the top of the cork 24. The user then grasps gripping elements **12*b* with one hand urging them radially inwardly and downwardly (as indicated by the arrows B) to grip the bottle neck as shown in FIG. 2. With the other hand, the user grasps the handle 20 and rotates the cork engaging member 18, 20 (as indicated by arrow A) while simultaneously bearing down on it to drive the corkscrew 18 into the cork 24. The length of corkscrew 18 is such that when hub 20*a* comes into engagement with the upper surface of bushing 16 thereby limiting further downward movement of the cork engaging member, the corkscrew 18 will have been driven through the lower end of cork 24. The user then continues to rotate the cork-engaging member 18, 20 in the direction of arrow A. Since the abutment of hub 20*a* with bushing 16 prevents further downward movement of the cork engaging member, such rotation will cause cork 24 to climb upwardly on the corkscrew 18**.

The user can observe the cessation of upward movement of cork 24 through the space between portions **12*a* of the two holder legs. He can then easily remove the cork 24** by lifting up on the holder.

The extractor apparatus can be then be used to remove the cork 24 from the corkscrew 18. By grasping the holder legs 12 and urging them radially inwardly, the user can grip the cork 24 with the flanges **12*c*. He can then remove the corkscrew 18 by simply rotating handle 20 in a direction opposite to that used to initially drive the corkscrew 18 into cork 24. Alternatively, cork 24 can be gripped by the user's fingers directly through the spaces between upper portions 12*a*** of the holder legs.

From the foregoing it can be seen that the apparatus of FIGS. 1, 2 and 12 provides a relatively simple and economical means by which a user can easily and accurately guide the corkscrew into the cork in a centered and coaxially aligned orientation. The holder of the apparatus permits the user to get a firm grip on the bottle while maintaining the guide means steadily aligned with the cork. The guide means in turn properly directs the corkscrew by guiding it via the O.D. of its own helix. Furthermore, it can be seen that the appratus substantially reduces the force which must be exerted in extracting the cork from the bottle by the threading interaction between the cork and screw, as opposed to a straight pull.

The fact that the cork engaging member 18, 20 is removable from the holder results in additional advantages. Not only does this removability permit the cork engaging member to be used as an ordinary corkscrew, if and when desired, but also allows the sharp end portion thereof to be used to sever the foil covering the top of the bottle before removal of the cork. Furthermore, the separability of the two major portions of the apparatus permits both portions to be more easily cleaned and permits one cork engaging member 18, 20 to be used alternatively with different types of holders, e.g. either with the holder of FIGS. 1, 2 and 12 or with the holder of FIGS. 3–8, as well as with holders of different sizes.

The apparatus further comprises improvements within the corkscrew 18 per se. As best seen in FIGS. 1 and 11, corkscrew 18 is formed from a length of high tensile metal wire wound into a helix. This wire forms the central metallic body **18*a* of the corkscrew. The resulting helix is ground to form a radially outwardly facing flat 18*b* along substantially its entire length, and is then coated with a layer 18*c* of friction reducing material such as polytetrafluoroethylene. The friction reducing coating substantially increases the ease with which the corkscrew 18 may be driven into the cork. Indeed, the reduction in friction is so great as to permit the use, in central body 18*a*, of design features and parameters which would not be practicable without layer 18*c*. For example, the wire of which body 18*a* is formed may be thinner than in conventional screws, and a wider range of helix leads is available. Such design features in turn may even further enhance the ease of insertion. Thus, for example, the use of layers 18*c*, especially in cooperation with other friction reducing features made possible thereby substantially ensures the capability of driving corkscrew 18 to a sufficient depth in cork 24, even where the latter is relatively hard and/or tightly engaged in the bottle neck, and even though the central body 18*a* of the corkscrew might be so flexible that it would, in the absence of layer 18*c***, be unwound or otherwise distorted in an attempt to drive it into a cork.

The flat **18*b* provides a greater contact area between the corkscrew and the guide surface 16*a* of the bushing 16 thereby reducing wear of layer 18*c*. Such wear is further reduced by the fact that bushing 16** itself is formed of a friction reducing material as noted hereinabove.

Referring now to FIGS. 3–10, there is shown a second embodiment of the invention which is capable of being used in two alternative modes of operation. The apparatus includes a cork engaging member substantially identical to that of the first embodiment (except that flat **18*b* may be eliminated). Accordingly, the parts of the cork engaging member, namely the corkscrew 18 and the handle 20** have been given like reference numberals.

The holder of the embodiment of FIGS. 3–10 includes an integrally molded main body member having an upper annulus 26. The main body member further comprises a plurality (in this case three) circumferentially spaced, longitudinally extending holder legs 28 symmetrically spaced about annulus 26 and extending downwardly therefrom. Each of the legs 28 includes an upper portion **28*a* and a lower portion 28*b* and has a downwardly facing shoulder 28*c* formed on its inner side at the juncture between the upper and lower portions 28*a* and 28*b*, respectively. Shoulders 28*c*** define a common plane transverse to the longitudinal axis of the holder and are adapted to rest on the upper edge of the bottle in use thereby serving as stop means to limit downward movement of the holder with respect to the bottle.

Holder legs 28 are, like holder legs 12 of the first embodiment, flexible and resilient. Therefore, the lower portions **28*b* of the holder legs are radially deflectable both inwardly and outwardly from a normal unflexed radial position (shown in FIGS. 3 and 7) and are substantially equally resiliently biased to such normal unflexed portion by virtue of the symmetry and resiliency of the legs 28 per se. Accordingly, lower portions 28*b* serve as gripping elements for engaging the neck of the bottle, while upper portions 28*a* connect the annulus 26 to the gripping elements 28*b* and space annulus 26** above the gripping elements by a distance sufficient to allow for the necessary movement of the cork during extraction thereof.

Annulus 26 serves as the foundation portion of the guide means of the holder. The guide means further includes a bushing assembly including a metallic sleeve 30 which is mounted within annulus 26 in a manner to be described below. Sleeve 30 has an annular flange 30*a* extending radially outwardly at the upper edge thereof and overlying the top of annulus 26. The bushing assembly further includes a generally cylindrical plug 32. As best shown in FIG. 9, sleeve 30 is internally threaded, and plug 32 is provided with mating external threads. Thus the plug 32 may be threaded into sleeve 30 and then held in place by a pin 31 inserted laterally through aligned bores 33 and 35 in the sleeve and plug respectively. Prior to such assembly, a deeper helical groove 32*a* is formed in the exterior of plug 32. Groove 32*a* is sized and configured to mate with the helix of corkscrew 18. Thus, when plug 32 is inserted in the sleeve 30, the groove 32*a* and the opposed radially inwardly facing surfaces of sleeve 30 form a helical guide passageway for receipt of the corkscrew. Accordingly, as the corkscrew 18 moves longitudinally upwardly or downwardly within the holder, it is maintained in substantially coaxial alignment therewith by the radially outwardly facing guide surfaces of grooves 32*a*, sized to lie closely adjacent to the inner diameter of the helix, and/or by the radially inwardly facing guide surfaces of sleeve 30, the diameter of which is sized to lie closely adjacent the outer diameter of the helix.

Figure 7:
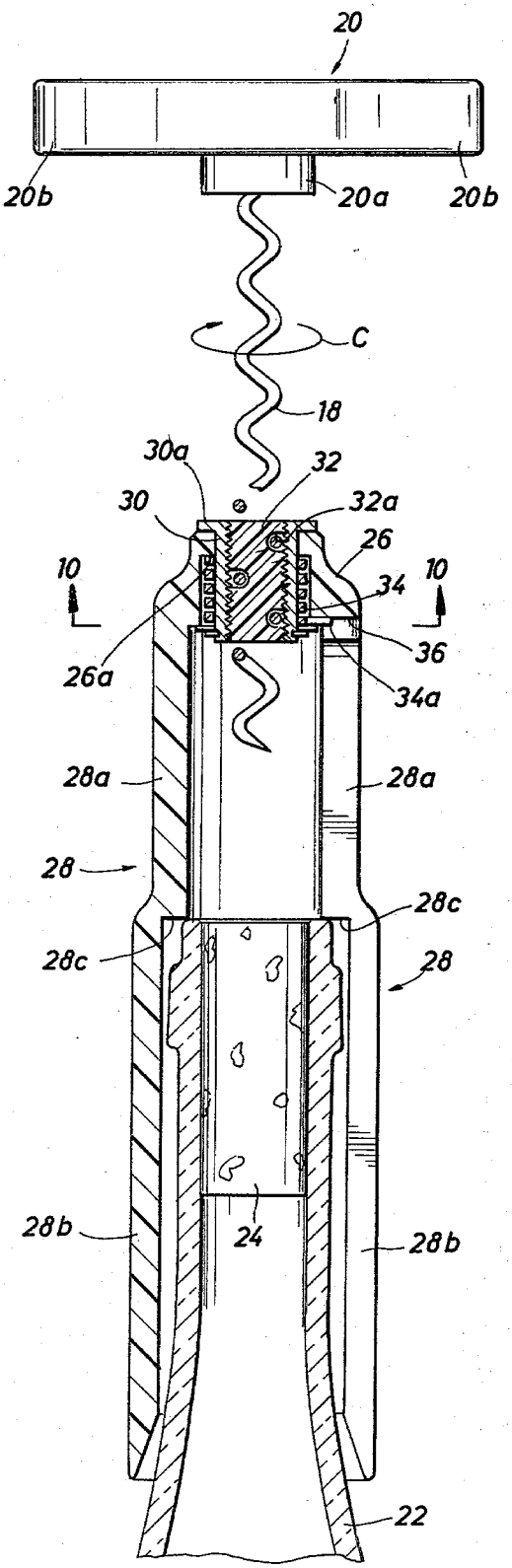
FIG. 7 is a longitudinal cross-sectional view, with certain parts shown in elevation, of the apparatus of FIGS. 3-6 positioned on a bottle for removing a cork therefrom.
Figure 8:
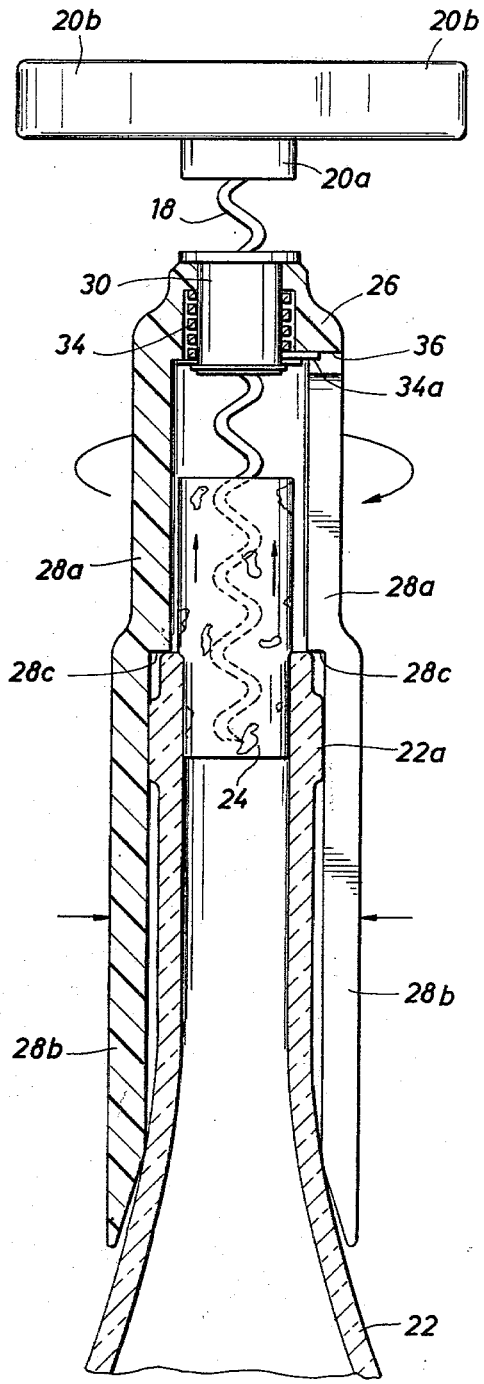
FIG. 8 is a view similar to that of FIG. 7 showing the apparatus as the cork is being extracted from the bottle.

As shown in FIGS. 7, 8 and 10, the bore through annulus 26 is undercut at 26*a* to provide a space for receipt of a helical spring 34 which is wound around sleeve 30. At its lower end, spring 34 has its tip portion 34*a* bent to extend radially outwardly into a slot 36 in annulus 26. End 34*a* is thus restrained against rotational movement within annulus 26. The remainder of spring 34 is wound on sleeve 30 in a clockwise direction (from top to bottom and as viewed from the top). Therefore, spring 34 will permit relative rotation between the bushing assembly 30, 32 and the foundation portion of the guide means, i.e. annulus 26, in a first directional mode which includes clockwise rotation of the bushing assembly and/or counterclockwise rotation of the foundation portion 26. However, attempted relative rotation in an opposite directional mode, including a counterclockwise rotation of the bushing assembly 30, 32 and/or clockwise rotation of the foundation portion 26, will cause spring 34 to tighten about sleeve 30 and prevent such relative rotation.

The operation of the apparatus can best be understood with reference to FIGS. 7 and 8. As mentioned above, the apparatus has two alternative modes of operation. The first of these modes is substantially identical to that of the first embodiment of the invention described hereinabove. Thus, in the first mode, the holder is emplaced over the top of the bottle 22 as shown in FIG. 7 with shoulders 28*c* resting on the upper edge of the bottle. The corkscrew 18 is then inserted into the helical guide passageway generally defined by grooves 32*a*. By rotating the cork engaging member in the direction of arrow C, i.e. clockwise, the lower end of the corkscrew is brought into abutment with the upper surface of cork 24.

The user now firmly grips the gripping elements 28*b* with one hand thus deflecting them into engagement with the drip ring 22*a* as shown in FIG. 8. Gripping elements 28*b* are preferably about 2½ inches or 6.4 cm. long, which for reasons explained above, renders them more readily capable of further gripping the bottle neck 22 at a second location spaced downwardly from drip ring 22*a*. The gripping elements 28*b* and shoulders 28*c* thus firmly and steadily position the holder on the bottle with the guide means 26, 30 and 32 substantially coaxially aligned with cork 24 in essentially the same manner as the corresponding parts of the first embodiment. Although gripping elements 28*b* are not flared outwardly as are gripping elements 12*b* of the first embodiment, it is still possible for the user to exert a sufficient downward force while squeezing inwardly on the gripping elements to maintain shoulders 28*c* in firm engagement with the top of the bottle. Furthermore, the fact that the gripping elements are sized to provide the aforementioned double gripping action at longitudinally spaced locations (at least on most sizes of wine bottles), further ensures that the user will be enabled to obtain a firm grip and that the holder will be steadily and properly positioned on the bottle.

With the other hand, the user now rotates the cork engaging member via handle 20 in the clockwise direction while simultaneously exerting a downward force. This drives corkscrew 18 into and through cork 24 until hub 20*a* of handle 20 is brought into abutment with the upper end of the bushing assembly 30,32. Continued rotation of the cork engaging member 18,20 along with the bushing assembly 30, 32 is now permitted by virtue of the action of spring 34, as described hereinabove. Thus, upon such continued rotation, cork 24 will rise on corkscrew 18 until it reaches a position where it can be easily removed from the bottle by lifting upwardly on the holder.

The second mode of operation is desirable if, for any reason, the user does not wish to drive the corkscrew 18 through the lower end of cork 24. For example, some persons believe that such practice will contaminate the wine with dust or tiny fragments from the cork. In the second mode of operaton, the holder is emplaced on and used to grip the bottle neck in precisely the same manner as in the first mode. The corkscrew 18 is inserted in the helical guide passageway and rotated via handle 20 in the clockwise direction until it comes into abutment with the upper end of the cork 24. The handle 20 is then further rotated in the same direction and urged downwardly to drive the screw 18 into the cork 24 a sufficient distance to obtain a firm grip on the cork but not completely through the lower end of the cork. Then, the main body 26, 28 of the holder is rotated in the clockwise direction, as indicated by the arrow D in FIG. 8. Since, as mentioned above, spring 34 will not permit clockwise rotation of annulus 26 relative to bushing assembly 30, 32 the latter will be constrained to rotate with the main body of the holder. Accordingly, rotation of the holder will cause the entire cork engaging member 18, 20 together with the attached cork 24 to be moved upwardly by the threading interaction between corkscrew 18 and groove 32. It will be noted that, since the holder 26, 28, 30 and 32 is rotating, members 18, 20 and 24 will move directly upwardly without rotating.

Regardless of which of the two modes of operation is employed, when the cork 24 has been raised a sufficient distance so that it no longer offers substantial friction resistance to movement, it can be completely removed from the bottle by lifting upwardly on the holder. The cork may then be removed from the corkscrew in substantially the same manner as in the embodiment of FIGS. 1, 2 and 12, i.e. by gripping the cork either directly or via the flexible holder legs 28 and rotating handle 20 in the counterclockwise direction. As in the first embodiment, the two major portions of the apparatus of FIGS. 3–10, i.e. the cork engaging member 18, 20 and the holder 26, 28, 30 and 32 are completely separable permitting the cork engaging member to be used independently of the holder and providing for easier cleaning, storage and replacement of the two major parts.

In a modification of the apparatus of FIGS. 3–11, the bushing assembly may be fixed in the foundation portion of the guide means, or the bushing assembly may be eliminated and the helical guide passageway defined by the main body of the holder. In such embodiments, there is a single mode of operation, i.e. that in which the holder (rather than the cork engaging member) is rotated to raise the cork.

Although the embodiments described above represent two preferred forms of the present invention, numerous modifications and combinations of their various features can be made by those skilled in the art without departing from the spirit of the invention. By way of example only, the form of the radially deflectable gripping elements and the manner in which they are resiliently biased could be altered. Also, as explained above, the preferred holders each include a number of different features for ensuring firm and proper alignment of the guide means with the cork and bottle. In some cases, adequate gripping and alignment action might be obtained with less than all such features, or additional alignment expedients, such as more or larger contact areas on the gripping elements, might be employed. Likewise, the form of the guide means and the manner in which it is connected to and spaced upwardly from the gripping elements could also be altered. More specifically, in the first embodiment of the invention, bushing 16 could be eliminated and the cylindrical guide passageway simply formed by the main body portion of the holder. Still other modifications might involve changes in the materials from which the various parts of the apparatus are formed. Accordingly, it is intended that the scope of the present invention be limited only by the claims which follow.

I claim:

1. Apparatus for extracting a cork from a bottle comprising:

a holder including guide means having a guide passageway extending generally longitudinally therethrough and having generally radially facing guide surface means;

stop means engageable with the bottle to limit downward movement of said holder with respect to the bottle and space said guide means from the top of the bottle; and grip means engageable with the bottle and comprising a plurality of longitudinally downwardly extending circumferentially spaced gripping elements having lower free ends which are radially deflectable and approximately equally resiliently biased to a normal unflexed radial position;

spacing means connecting the upper ends of said gripping elements to and spacing them downwardly from said guide means by a distance such that, when said stop means are engaged with the bottle, said gripping elements are generally radially aligned with the neck of the bottle;

a cork engaging member including a corkscrew, said cork engaging member having a guide portion rotatably and longitudinally movable in said guide passageway, said guide portion having a diameter sized to lie closely adjacent said guide surface means.

2. The apparatus of claim 1 wherein said guide portion of said cork-engaging member is said corkscrew.

3. The apparatus of claim 2 wherein said cork-engaging member further comprises abutment means carried on said corkscrew and engageable with said holder to limit downward movement of said cork-engaging member with respect to said holder.

4. The apparatus of claim 3 wherein said stop means comprise generally downwardly facing stop shoulder means engageable with the top of the bottle, said grip means extending generally downwardly below said stop shoulder means.

5. The apparatus of claim 4 wherein said gripping elements are radially resiliently flexible.

6. The apparatus of claim 4 wherein said holder comprises a plurality of longitudinally downwardly extending, circumferentially spaced holder legs, each of said holder legs having a lower portion forming a respective one of said gripping elements and an upper portion forming a part of said spacing means.

7. The apparatus of claim 6 wherein each of said holder legs defines a respective downwardly facing stop shoulder on its inner side, said stop shoulders being generally coplanar and together comprising said stop shoulder means.

8. The apparatus of claim 7 wherein said upper portion of each of said holder legs is radially resiliently flexible.

9. The apparatus of claim 8 wherein said lower portion of each of said holder legs is radially resiliently flexible.

10. The apparatus of claim 7 wherein said holder legs include generally upwardly facing bearing surfaces on their outer sides, said bearing surfaces being engageable to urge said stop shoulder means downwardly into tight engagement with the top of said bottle.

11. The apparatus of claim 10 wherein said bearing surfaces are spaced downwardly from said stop shoulder means.

12. The apparatus of claim 11 wherein each of said holder legs is flared radially outwardly adjacent its lower end to form a respective one of said bearing surfaces.

13. The apparatus of claim 2 wherein said corkscrew is helical and wherein said guide passageway is cylindrical and has a length at least as long as the pitch of the helix of said corkscrew.

14. The apparatus of claim 13 wherein said corkscrew has a radially outwardly facing flat formed along at least a substantial portion of its length.

15. The apparatus of claim 14 wherein said corkscrew comprises a central body and an outer layer of friction reducing material.

16. The apparatus of claim 15 wherein said outer layer of friction reducing material is comprised of polytetrafluoroethylene.

17. The apparatus of claim 2 wherein said corkscrew is helical and wherein said guide passageway is helical and configured to mate with the helix of said corkscrew.

18. The apparatus of claim 17 wherein said guide means comprises a foundation portion, bushing means mounted in said foundation portion and defining said helical guide passageway, and means cooperative between said foundation portion and said bushing means operative to permit relative rotation between said foundation portion and said bushing means in a first directional mode but prevent relative rotation between said foundation portion and said bushing means in a second directional mode opposite to said first mode.

19. The apparatus of claim 1 wherein said cork engaging member is separable from said holder.

20. The apparatus of claim 1 wherein said corkscrew comprises a central body and an outer layer of friction reducing material.

21. The apparatus of claim 20 wherein said friction reducing material is polytetrafluoroethylene.

22. The apparatus of claim 20 wherein said corkscrew has a radially outwardly facing flat formed along at least a substantial portion of its length.

23. Apparatus for extracting a cork from a bottle comprising:

a holder including guide means having a guide passageway extending generally longitudinally therethrough and having generally radially facing guide surface means;

stop means engageable with the bottle to limit downward movement of said holder with respect to the bottle; and grip means connected to and spaced downwardly from said guide means and engageable with the bottle to radially align said guide means with the bottle; and a cork-engaging member including a generally helical corkscrew, for at least partial passage into the cork and longitudinally movable in said guide passageway, selectively with or without simultenaous rotation and having a diameter sized to lie closely adjacent said guide surface means, said corkscrew comprising a central body and an outer layer of friction reducing material.

24. The apparatus of claim 23 wherein said cork-engaging member is separable from said holder by removal of said corkscrew from said guide passageway.

25. The apparatus of claim 24 wherein said guide passageway is helical and configured to mate with the helix of said corkscrew, and wherein said guide means comprises a foundation portion, bushing means mounted in said foundation portion and defining said helical guide passageway, and means cooperative between said foundation portion and said bushing means operative to permit relative rotation between said foundation portion and said bushing means in a first directional mode but prevent relative rotation between said foundation portion and said bushing means in a second directional mode opposite to said first mode.

26. The apparatus of claim 23 wherein said cork engaging member further comprises abutment means carried on said corkscrew and engageable with said holder to limit downward movement of said cork-engaging member with respect to said holder.

27. The apparatus of claim 26 wherein said guide passageway is cylindrical and has a length at least as long as the pitch of the helix of said corkscrew.

28. Apparatus for extracting a cork from a bottle comprising:

a holder including guide means comprising a foundation portion, bushing means mounted in said foundation portion and defining a helical guide passageway extending generally longitudinally therethrough, and means cooperative between said foundation portion and said bushing means operative to permit relative rotation between said foundation portion and said bushing means in a first directional mode but prevent relative rotation between said foundation portion and said bushing means in a second directional mode opposite to said first mode; and stop means engageable with the bottle to limit downward movement of said holder with respect to the bottle; and a cork-engaging member including a helical corkscrew movable in said guide passageway.

29. The apparatus of claim 28 wherein said cork-engaging member further comprises abutment means carried on said corkscrew and engageable with said holder to limit downward movement of said cork-engaging member with respect to said holder.

30. The apparatus of claim 28 wherein said holder further comprises grip means engageable with the bottle to radially align said guide means with the bottle and including a plurality of longitudinally extending, circumferentially spaced, radially deflectable gripping elements connected to and spaced downwardly from said guide means.

31. The apparatus of claim 28 wherein said corkscrew comprises a central body and an outer layer of friction reducing material.

32. Apparatus for extracting a cork from a bottle comprising:

a holder including guide means having a guide passageway extending generally longitudinally therethrough and having generally radially facing guide surface means;

a plurality of longitudinally extending, circumferentially spaced holder legs, each of said holder legs having a lower portion forming a respective radially deflectable gripping element engageable with the bottle, said gripping elements being approximately equally resiliently biased to a normal, unflexed radial position, and an upper portion connecting said respective gripping element to said guide means and spacing it downwardly therefrom, each of said holder legs further defining a respective downwardly facing stop shoulder on its inner side, said stop shoulders being generally coplaner and together comprising stop means engageable with the top of the bottle to limit downward movement of said holder with respect to the bottle, and said holder legs further including generally upwardly facing bearing surfaces on their outer sides, said bearing surfaces being engageable to urge said stop shoulders downwardly into tight engagement with the top of the bottle; and a cork engaging member including a corkscrew, said cork engaging member having a guide portion rotatably and longitudinally movable in said guide passageway, said guide portion having a diameter sized to lie closely adjacent said guide surface means.

* * * * *

UNITED STATES PATENT AND TRADEMARK OFFICE

CERTIFICATE OF CORRECTION

PATENT NO. : 4,276,789

DATED : July 7, 1981

INVENTOR(S) : Herbert Allen

It is certified that error appears in the above-identified patent and that said Letters Patent is hereby corrected as shown below:

Column 12, Claim 11, line 42, "10" should read -- 32 --.

Signed and Sealed this

*Seventh* Day of *May 1985*

[SEAL]

*Attest:*

DONALD J. QUIGG

*Attesting Officer* *Acting Commissioner of Patents and Trademarks*

REEXAMINATION CERTIFICATE (1582nd)

United States Patent [19]

Allen

[11] B1 4,276,789

[45] Certificate Issued Oct. 29, 1991

[54] CORK EXTRACTOR

[75] Inventor: Herbert Allen, Houston, Tex.

[73] Assignee: Hallen Company, Houston, Tex.

Reexamination Request:
No. 90/002,315, Apr. 5, 1991

Reexamination Certificate for:

| | |
|---|---|
| Patent No.: | **4,276,789** |
| Issued: | **Jul. 7, 1981** |
| Appl. No.: | **925,365** |
| Filed: | **Jul. 17, 1978** |

[51] Int. Cl.[5] ..... B67B 7/00
[52] U.S. Cl. ..... 81/3.36; 81/3.48
[58] Field of Search ..... 81/3.09, 3.35, 3.37, 81/3.29, 3.48; 30/346, 346.53, 350

[56] References Cited

FOREIGN PATENT DOCUMENTS

| | | |
|---|---|---|
| 21543 | 3/1883 | Fed. Rep. of Germany . |
| 23110 | 8/1883 | Fed. Rep. of Germany . |
| 59259 | 4/1891 | Fed. Rep. of Germany . |
| 815 | 3/1897 | Fed. Rep. of Germany . |
| 99374 | 12/1897 | Fed. Rep. of Germany . |
| 19206 | 3/1982 | Fed. Rep. of Germany . |
| 85485 | 3/1985 | Fed. Rep. of Germany . |
| 927558 | 5/1947 | France . |
| 2340898 | 9/1977 | France . |
| 1022635 | 10/1974 | Italy . |
| 46966 | 12/1909 | Switzerland . |
| 423527 | 10/1966 | Switzerland . |
| 7761 | of 1839 | United Kingdom . |
| 8224 | of 1840 | United Kingdom . |
| 17924 | of 1893 | United Kingdom . |
| 8711 | of 1902 | United Kingdom . |
| 192503 | 2/1922 | United Kingdom . |

OTHER PUBLICATIONS

"Corkscrews for Collectors", by Watney and Babbidge, 1981 (pp. 80–81).

Brochure entitled "Sanbri Selection", Jan. 1977 with attached copy of Reexamination Certificate for U.S. Pat. No. 4,291,597.

*Primary Examiner*—James G. Smith

[57] ABSTRACT

The invention pertains to an apparatus for extracting a cork from a bottle comprising a cork-engaging member, including a corkscrew, and a holder for aligning and guiding the corkscrew, via its own diameter, with respect to the bottle. The cork-engaging member is completely removable from the holder for independent use, and to permit the corkscrew point to be used to sever the metal foil, which covers the bottle top, and both the holder and cork engaging member to be more easily cleaned. The holder includes a plurality of longitudinally extending circumferentially spaced, radially deflectable gripping elements connected to and spaced downwardly from a guide which receives the corkscrew, and are all approximately equally resiliently biased to a normal unflexed radial position. One embodiment is capable of two alternative modes of operation. The corkscrew itself is improved by the provision of an outer layer of friction reducing material.

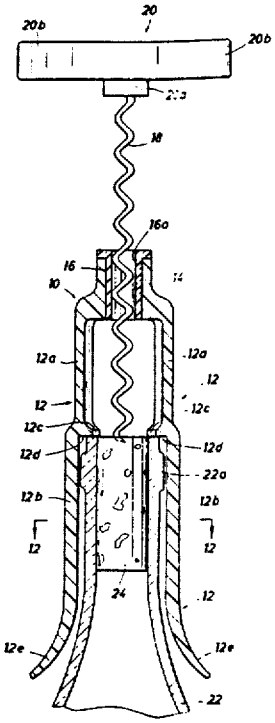

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 28–31 is confirmed.

Claims 5, 8 and 9 are cancelled.

Claims 1, 6, 23 and 32 are determined to be patentable as amended.

Claims 2–4, 7, 10–22 and 24–27, dependent on an amended claim, are determined to be patentable.

New claims 33–37 are added and determined to be patentable.

1. Apparatus for extracting a cork from a bottle comprising:

a holder including guide means having a guide passageway extending generally longitudinally therethrough and having generally radially facing guide surface means;

stop means engageable with the bottle to limit downward movement of said holder with respect to the bottle and space said guide means from the top of the bottle; and grip means engageable with the bottle and comprising a plurality of longitudinally downwardly extending circumferentially spaced gripping elements *opposite the guide means with respect to the stop means and radially deflectable for gripping engagement with the bottle, the gripping elements* having lower free ends which are radially deflectable and approximately equally resiliently biased to a normal unflexed radial position;

spacing means *between the stop means and the guide means and* connecting the upper ends of said gripping elements to and spacing them downwardly from said guide means by a distance such that, when said stop means are engaged with the bottle, said gripping elements are generally radially aligned with the neck of the bottle, *said spacing means being radially and resiliently flexible to radially deflect the gripping elements into gripping engagement with the bottle;* a cork engaging member including a corkscrew, said cork engaging member having a guide portion rotatably and longitudinally movable in said guide passageway, said guide portion having a diameter sized to lie closely adjacent said guide surface means.

6. The apparatus of claim [4] *1* wherein said holder comprises a plurality of longitudinally downwardly extending, circumferentially spaced holder legs, each of said holder legs having a lower portion forming a respective one of said gripping elements and an upper portion forming a part of said spacing means.

23. Apparatus for extracting a cork from a bottle comprising:

a holder including guide means having a guide passageway extending generally longitudinally therethrough and having generally radially facing guide surface means;

stop means engageable with the bottle to limit downward movement of said holder with respect to the bottle; and grip means connected to and spaced downwardly from said guide means and engageable with the bottle to radially align said guide means with the bottle, *said grip means supporting the stop means and being radially and resiliently flexible to radially deflect both the stop means and the grip means into engagement with the bottle while the guide means is aligned with the bottle*; and a cork-engaging member including a generally helical corkscrew, for at least partial passage into the cork and longitudinally movable in said guide passageway, selectively with or without simultaneous rotation and having a diameter sized to lie closely adjacent said guide surface means, said corkscrew comprising a central body and an outer layer of friction reducing material.

32. Apparatus for extracting a cork from a bottle comprising:

a holder including guide means having a guide passageway extending generally longitudinally therethrough and having generally radially facing guide surface means;

a plurality of longitudinally extending, circumferentially spaced holder legs, each of said holder legs having a lower portion forming a respective radially deflectable gripping element engageable with the bottle, said gripping elements being approximately equally resiliently biased to a normal, unflexed radial position, and an upper portion connecting said respective gripping element to said guide means and spacing it downwardly therefrom, each of said holder legs further defining a respective downwardly facing stop shoulder on its inner side, said stop shoulders being generally coplanar and together comprising stop means engageable with the top of the bottle to limit downward movement of said holder with respect to the bottle, *said upper portion of said holder legs being spaced between said stop shoulders and said guide means and being radially and resiliently flexible to radially deflect the lower portions of the holder legs into gripping engagement with the bottle,* and said holder legs further including generally upwardly facing bearing surfaces on their outer sides, said bearing surfaces being engageable to urge said stop shoulders downwardly into tight engagement with the top of the bottle; and a cork engaging member including a corkscrew, said cork engaging member having a guide portion rotatably and longitudinally movable in said guide passageway, said guide portion having a diameter sized to lie closely adjacent said guide surface means.

*33. The apparatus of claim 1, wherein the stop means are fixed on lowermost portions of the spacing means.*

*34. The apparatus of claim 1, wherein the corkscrew is rotatably and longitudinally movable within the guide passageway.*

*35. The apparatus of claim 1, further comprising:*

*the holder including a plurality of longitudinally downwardly extending, circumferentially spaced holder legs, each of the holder legs having a lower portion forming a respective one of the gripping elements and an upper portion forming at least a part of the spacing means;*

*the cork-engaging member further includes abutment means carried on the corkscrew and engageable with the holder to limit downward movement of the cork-engaging member with respect to the holder; and*

*the upper portion of the holder legs define an opening therebetween for receipt of the cork as it emerges from the bottle, the corkscrew being of a length such that, when the abutment means are engaged with the holder to limit downward movement of the corkscrew, the corkscrew extends into the opening whereby the cork may move threadedly upward on the corkscrew as the corkscrew is rotated to withdraw the cork from the bottle.*

*36. The apparatus of claim 23, further comprising:*

*the cork-engaging member further includes abutment means carried on the corkscrew and engageable with the holder to limit downward movement of the cork-engaging member with respect to the holder; and*

*an upper portion of the grip means defining an opening for receipt of the cork as it emerges from the bottle, the corkscrew being of a length such that, when the abutment means are engaged with the holder to limit downward movement of the corkscrew, the corkscrew extends into the opening whereby the cork may move threadedly upward on the corkscrew as the corkscrew is rotated to withdraw the cork from the bottle.*

*37. The apparatus of claim 32, further comprising:*

*the cork-engaging member further includes abutment means carried on the corkscrew and engageable with the holder to limit downward movement of the cork-engaging member with respect to the holder; and*

*the upper portion of the holder legs define an opening therebetween for receipt of the cork as it emerges from the bottle, the corkscrew being of a length such that, when the abutment means are engaged with the holder to limit downward movement of the corkscrew, the corkscrew extends into the opening whereby the cork may move threadedly upward on the corkscrew as the corkscrew is rotated to withdraw the cork from the bottle.*

* * * * *